United States Patent [19]

Ehrat

[11] 4,365,802

[45] Dec. 28, 1982

[54] DEFORMATION-PREVENTING SWINGABLE MOUNT FOR BASKETBALL GOALS

[76] Inventor: Arthur H. Ehrat, Farmers Elevator Co., Lowder, Ill. 62662

[21] Appl. No.: 708,581

[22] Filed: Jul. 26, 1976

[51] Int. Cl.[3] ..... A63B 63/08

[52] U.S. Cl. ..... 273/1.5 R

[58] Field of Search ..... 273/1.5, 105; 172/261–265; 248/475 B, 475 A

[56] References Cited

U.S. PATENT DOCUMENTS

| | | | |
|---|---|---|---|
| 48,069 | 6/1865 | Ingels | 172/265 |
| 170,627 | 11/1875 | Harris | 172/265 |
| 301,545 | 7/1887 | Wheeler | 172/265 |
| 418,503 | 12/1889 | Crane | 172/266 |
| 1,253,961 | 1/1918 | Grismond | 172/265 |
| 2,395,342 | 2/1946 | Morkoski | 172/265 |
| 2,742,843 | 4/1956 | Redetzke | 172/264 |
| 3,194,555 | 7/1965 | Humphrey | 273/1.5 R |
| 3,795,396 | 3/1974 | Kropelnitski | 273/1.5 A X |
| 4,111,420 | 9/1978 | Tyner | 273/1.5 R |

FOREIGN PATENT DOCUMENTS

| | | | |
|---|---|---|---|
| 1115603 | 10/1961 | Fed. Rep. of Germany | 248/475 A |
| 1479428 | 3/1967 | France | 248/475 B |

*Primary Examiner*—Paul E. Shapiro

*Attorney, Agent, or Firm*—Ralph F. Staubly

[57] ABSTRACT

The mounting bracket for the ring of a basketball goal is yieldably swingably movable downwardly, or both downwardly and laterally, responsively to application of potentially deforming or damaging forces. Strong magnets or equivalent structure firmly hold the bracket against movement by normal game-applied forces. Pivotal movement is provided by a hinge or a ball-and-socket connector. A coil spring behind the goal backboard and connected to the bracket by a flexible cable, or a leaf or coil spring, can be employed to automatically return the temporarily displaced goal to its normal position.

11 Claims, 6 Drawing Figures

DEFORMATION-PREVENTING SWINGABLE MOUNT FOR BASKETBALL GOALS

BACKGROUND AND OBJECTS OF THE INVENTION

The ring of a basketball goal is frequently bent out of shape by excessive (e.g. body-engagement) force being applied thereto, which happening requires annoying and costly game-delaying repairs. It is accordingly the object of this invention to provide a simple, inexpensive, yet highly effective means for minimizing the probability of such damage and such game delay.

DETAILED DESCRIPTION

Figure 2:
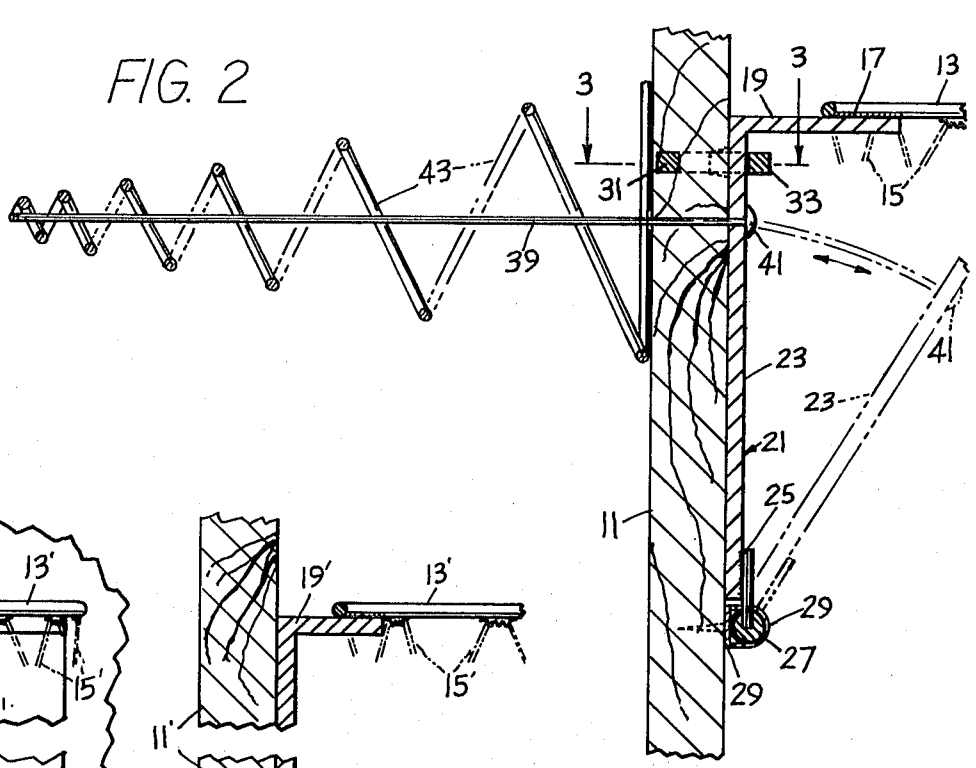
FIG. 2 is a side elevational view of the showing of FIG. 1 in section taken on the line 2—2 of FIG. 1.
Figure 3:
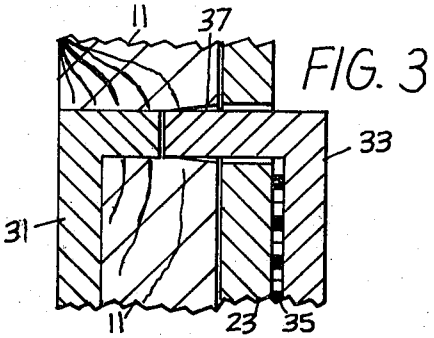
FIG. 3 is an enlarged fragmentary plan view in section taken on the line 3—3 of FIG. 2.
Figure 1:
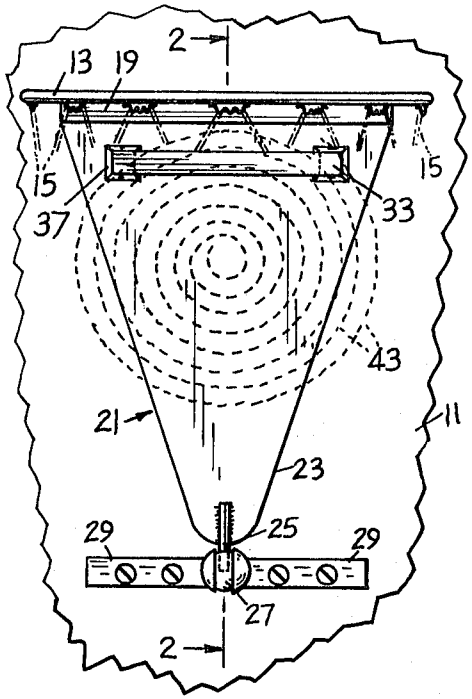
FIG. 1 is a front elevational view of a preferred embodiment of the invention.
Figure 4:
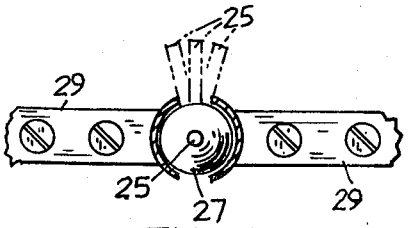
FIG. 4 is an enlarged elevational view of the ball-and-socket portion of FIG. 1.

With reference now to FIGS. 1–4 of the drawings, the numeral 11 designates a conventional backboard, upon which is to be mounted a conventional basket comprising a metal-rod ring 13 and a mesh basket 15. The ring 13 is welded at 17 to the horizontal base 19 of an inverted L-shaped bracket 21, the longer reach 23 of which may be tapered as shown in FIG. 1. A pin 25 is welded to the lower front of the reach 23 medially thereof to mount a ball 27 thereto. The ball 27 is received in a socket formed by a pair of elements 29 of known construction to permit the bracket 21 and its carried goal elements 13 and 15 to yieldably swing away from the backboard 11 as shown in FIGS. 2 and 4.

The bracket 21 is normally firmly held in its position of FIGS. 1 and 2 by a pair of shallow U-shaped powerful permanent magnets 31 and 33. The bight portion of the magnet 33 is cemented (e.g. by an epoxy film 35) to the bracket reach 21 (FIG. 3).

The mating poles of the magnets are shown as extending through alined apertures in the bracket arm 23 and the backboard 11. The front portions of the backboard apertures are tapered at 37 (FIGS. 1 and 3) to guide the bracket 21 back to its proper position, to which it preferably would be automatically returned by the pull of a flexible cable 39. The forward end of the cable 39 is welded at 41 to the bracket arm 23 and at its rear end to the apex of a tapered coiled compression spring 43. The cable 39 also roughly guides the bracket and goal elements to their playing positions after a displacement. Other guidance means may be employed, e.g. conical protuberances and mating depressions (not shown).

Figure 6:
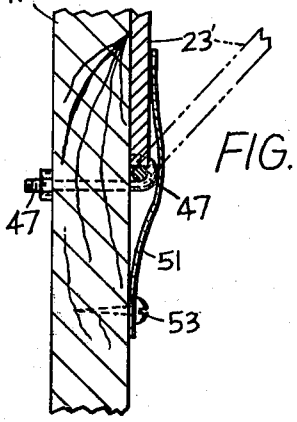
FIG. 6 is a side elevational view of the showing of FIG. 5 in section taken on the line 6—6 of FIG. 5.
Figure 5:
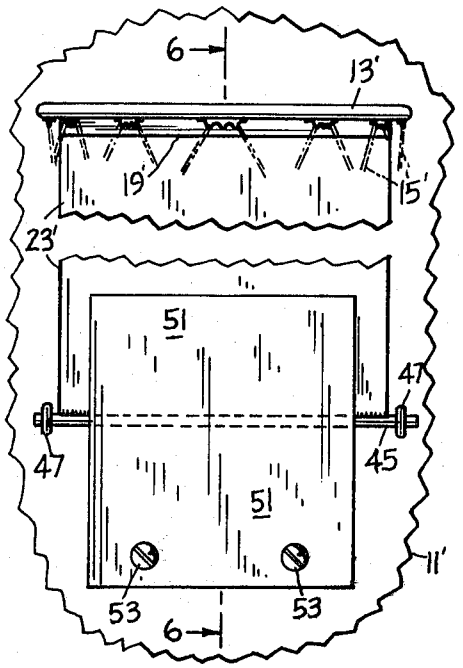
FIG. 5 is a front elevational view of a second species of the invention.

In the species of FIGS. 5 and 6, primed numerals designate like parts in the FIGS. 1–4 species. But in this more simple modification only downward and forward displacement (the more likely to occur) is provided for by a horizontal-axis hinge. The hinge comprises a rod 45 welded to the lower edge of bracket arm 23'. Two bearing-forming J-shaped threaded elements 47 extend through the backboard and are anchored by nuts 49. A leaf spring 51 is fixed in place by screws 53. A known mouse-trap-type coil spring (not shown) could be substituted for the spring 51.

Having thus described my invention, I claim:

1. A basketball-goal assemblage comprising: support structure for relatively immovable attachment to a basketball backboard, relatively movable goal-ring structure yieldably swingably connected to said support structure, and means interacting between said structures to hold said structures in normal positions against normal game-applied forces but yieldable to permit shock-absorbing swinging of said goal-ring structure for minimizing goal damage from abnormal forces applied thereagainst.

2. Mechanism according to claim 1 in which said relative swinging action is provided by an arm connected to the rear margin of said goal-ring structure and extending downwardly over the face of said backboard and pivoted thereto by a hinge.

3. Mechanism according to claim 2, said interacting means comprising at least one pair of co-operating magnetic elements matingly attached to and interacting between said relatively movable structures.

4. Mechanism according to claim 3 and additionally comprising spring means for returning said movable structure to its normal position.

5. Mechanism according to claim 4, said spring means comprising a compression spring located behind said backboard and connected to said movable structure by a flexible cable passing through a retraction-guiding bore in said backboard.

6. Mechanism according to claim 4, said spring means being a leaf-spring overlying a horizontal-axis hinge at the lower margin of said downwardly extending arm.

7. Mechanism according to claim 3, at least one magnetic element lying in a dished despression and its co-operating element being guided into said depression for guidingly positioning and holding said relatively movable structures in normal positions.

8. Mechanism according to claim 2, said hinge being of the ball-and-socket type.

9. Mechanism according to claim 8, said interacting means comprising at least one pair of co-operating magnetic elements matingly attached to and interacting between said relatively movable structures.

10. Mechanism according to claim 9 and additionally comprising spring means for returning said movable structure to its normal position.

11. A basketball-goal assemblage comprising: support structure for relatively immovable attachment to a basketball backboard, relatively movable goal-ring structure yieldably swingably connected to said support structure, means interacting between said structures to hold said structures in their normal relative positions against their relative movement by normal game-applied forces but yieldable with initially rapidly decreasing force-resistance to permit shock-absorbing swinging of said goal-ring structure for minimizing goal damage from abnormal forces applied thereagainst, and relatively weak force-applying means for returning said goal-ring structure to its normal interacting-means-held position.

* * * * *